US009982928B2

(12) United States Patent
Jansen

(10) Patent No.: US 9,982,928 B2
(45) Date of Patent: May 29, 2018

(54) METHOD FOR CONTROLLING A COMPRESSOR OF A REFRIGERATION SYSTEM COMPRISING A MOTOR, AND A COMPRESSOR OF A REFRIGERATION SYSTEM

(71) Applicant: KRIWAN Industrie-Elektronik GmbH, Forchtenberg (DE)

(72) Inventor: Kurt Jansen, Pfedelbach (DE)

(73) Assignee: KRIWAN Industrie-Elektronik GmbH, Forchtenberg (DE)

( * ) Notice: Subject to any disclaimer, the term of this patent is extended or adjusted under 35 U.S.C. 154(b) by 304 days.

(21) Appl. No.: 14/761,977

(22) PCT Filed: Feb. 10, 2014

(86) PCT No.: PCT/EP2014/052542
§ 371 (c)(1),
(2) Date: Jul. 20, 2015

(87) PCT Pub. No.: WO2014/124898
PCT Pub. Date: Aug. 21, 2014

(65) Prior Publication Data

US 2015/0316304 A1 Nov. 5, 2015

(30) Foreign Application Priority Data

Feb. 13, 2013 (DE) ..... 10 2013 101 418

(51) Int. Cl.
*F25B 1/00* (2006.01)
*F25B 49/00* (2006.01)
(Continued)

(52) U.S. Cl.
CPC ..... *F25B 49/02* (2013.01); *F04B 49/03* (2013.01); *F04B 49/06* (2013.01); *F04B 49/065* (2013.01); *F04B 49/225* (2013.01); *F25B 13/00* (2013.01)

(58) Field of Classification Search
CPC ..... F25B 49/02; F25B 13/00; F04B 49/225; F04B 19/065; F04B 49/03; F04B 49/06
See application file for complete search history.

(56) References Cited

U.S. PATENT DOCUMENTS 6,206,652 B1 * 3/2001 Caillat ..... F04B 49/06 417/222.1
2006/0218959 A1 * 10/2006 Sandkoetter ..... F04B 49/225 62/324.1
(Continued)

FOREIGN PATENT DOCUMENTS

DE 102004048940 A1 4/2006
EP 0982497 A1 3/2000
EP 1710435 A1 10/2006

*Primary Examiner* — Larry Furdge
(74) *Attorney, Agent, or Firm* — Renner Kenner Greive Bobak Taylor & Weber

(57) ABSTRACT

A method for controlling a compressor of a refrigeration system wherein refrigerant flow through the compressor is controlled by at least one valve, whereby the valve is opened or closed in a cycle of consecutive time intervals of an identical length, so that the valve is either completely closed or completely open during a time interval, whereby a. determining a percentage capacity for the compressor-corresponding to the current refrigeration requirement of a refrigeration location, b. determining the open time percentage of the valves over a number of time intervals, c. opening the valve for the following time interval when the ratio of the percentage capacity is greater than that of the open time percentage previously determined, and (Continued)

d. closing the valve-for the following time interval when the ratio of the percentage capacity is smaller than that of the open time percentage of the valves previously determined.

8 Claims, 2 Drawing Sheets

(51) Int. Cl.

| | |
|---|---|
| ***F25B 49/02*** | (2006.01) |
| ***F25B 13/00*** | (2006.01) |
| ***F04B 49/03*** | (2006.01) |
| ***F04B 49/06*** | (2006.01) |
| ***F04B 49/22*** | (2006.01) |

(56) References Cited

U.S. PATENT DOCUMENTS

| | | | | |
|---|---|---|---|---|
| 2009/0031740 | A1 | 2/2009 | Douglas | |
| 2009/0205349 | A1* | 8/2009 | Lifson | F04B 49/225 62/231 |

* cited by examiner

V = 100
V = 0
F
S
[%]
[s]
100
80
60
40
20
0
90
70
50
30
10
920
900
880
860
840
820
800
780
760
740
720
700
680
660
640
620
600
580
560
540
520
500
480
460
440
420
400
380
360
340
320
300
280
260
240
220
200
180
160
140
120
100
80
60
40
20
0

METHOD FOR CONTROLLING A COMPRESSOR OF A REFRIGERATION SYSTEM COMPRISING A MOTOR, AND A COMPRESSOR OF A REFRIGERATION SYSTEM

CROSS-REFERENCE TO RELATED APPLICATIONS

This application is a National Stage application of International Application No. PCT/EP2014/052542, and claims the benefit of German Patent Application No. 10 2013 101 418.6 filed Feb. 13, 2013, both incorporated herein by reference.

TECHNICAL FIELD

The invention concerns a method for controlling a compressor of a refrigeration system comprising a motor, whereby a controller controls the refrigerant flow through the compressor via at least one valve. The invention further concerns a compressor of a refrigeration system.

BACKGROUND OF THE INVENTION

With conventional refrigeration systems a regulator for detecting the current refrigeration requirement of a refrigeration location is envisaged in addition to the compressor. If the regulator detects an increased refrigeration requirement, the compressor will be controlled by the regulator in the sense of a capacity increase.

A method for controlling the capacity of a refrigeration system compressor is known from DE 10 2004 048 940 A1, whereby the compressor comprises a pneumatic or hydraulic servo mechanism for an intermittent interruption of the supply of refrigerant to a suction area. The compressor further comprises a regulator, with which a pulse width modulated switching signal can be generated for the pneumatic or hydraulic servo mechanism, for controlling the intermittent interruption of the refrigerant supply. The scan/pause ratio for controlling the pneumatic or hydraulic servo mechanism can be adapted to suit the refrigeration location if necessary.

The valve for influencing the refrigerant flow can also be controlled with a pulse width modulated switching signal as disclosed in EP 982 497 B1, whereby the valve is completely opened in one phase of a time interval, and completely closed in the other phase. The ratio of the two phases reflects the currently required refrigeration requirement of the refrigeration location. By setting the ratio of an opening phase and a closing phase the capacity of the compressor can be set between 0 and 100%. With a cycle time of 10 s it is possible to react very quickly to changes in the refrigeration requirements of the refrigeration location on the one hand, whilst the switching frequency of the valves is limited to a reasonable extent on the other. Although a shorter cycle time would shorten the reaction time to changed conditions at the refrigeration location, the working life of the valves used would also shorten correspondingly.

SUMMARY OF THE INVENTION

It is therefore the purpose of the invention to improve the method for controlling a compressor of a refrigeration system comprising a motor, or the compressor of a refrigeration system, in such a way that a fast reaction to changes in the refrigeration requirements of the refrigeration location remains guaranteed, and the number of switching processes of the valves from the open to the closed position and vice versa is clearly reduced.

This task is solved in accordance with the invention by the characteristics of claims 1 and 8.

With the method according to the invention for controlling compressor of a refrigeration system comprising a motor, the refrigerant flow through the compressor is controlled via at least one valve, whereby the valve is cyclically controlled by consecutive time intervals of an identical length, either in the sense of opening or in the sense of closing, so that the valve is either completely closed or completely open during a time interval, whereby a. a percentage capacity is determined for the compressor, which corresponds to the current refrigeration requirement of a refrigeration location,
b. the open time percentage of the valves is determined over a number of time intervals that include the current time interval and further time intervals preceding the same,
c. the valve is opened for the following time interval when the ratio of the percentage capacity of the refrigeration requirement of the compressor is greater than that of the open time percentage the valves detected in the past, and
d. the valve is closed for the following time interval when the ratio of the percentage capacity of the refrigeration requirement of the compressor is smaller than that of the open time percentage of the valves determined in the past.

The compressor of a refrigeration according to the invention system substantially consists of a motor for compressing a refrigerant flow, at least one valve for influencing the volume of the refrigerant flow through the compressor, a control device for controlling the valves, whereby the valve can be controlled in a cycle of consecutive time intervals of an identical length, either in the sense of opening or in the sense of closing, so that the valve is either completely closed or completely open during a time interval, at least one sensor unit for detecting a percentage capacity of the compressor corresponding to the current refrigeration requirement of a refrigeration location, an evaluation unit for detecting the percentage open time of the valves over a number of time intervals that includes the current time interval and further preceding time intervals, whereby the control device is connected with the evaluation unit and is designed in such a way that the valve is opened for the following time interval when the ratio of the percentage capacity of the compressor corresponding to the refrigeration requirement is greater than the open time percentage of the valves determined in the past, and the valve is closed for the following time interval when the ratio of the percentage capacity corresponding to the compressor of the refrigeration requirement is smaller than the open time percentage of the valves determined in the past.

Whilst the valve is opened once and closed once during each time interval/cycle in EP 0 982 497 B1, the valve regulated according to the invention remains in one condition throughout the entire regulated time interval. The valve is therefore not controlled by means of a pulse width modulated signal, but the open time percentage over a number of time intervals including the current time interval, and preceding time intervals following the same, are determined and compared with the percentage capacity of the compressor currently required. This can also result in the valve remaining closed or open for several consecutive time intervals.

The length of the time interval will be selected similarly short to that of EP 0 982 497 B1 and preferably lies within a range of 2 to 20 s. If the measurement of the refrigeration requirements of the refrigeration location is carried out during a comparatively short time interval, it may be possible to react to changed refrigeration requirements as early as during the next time interval. The switching frequency of the valves necessary for the realisation of the method is however clearly reduced. Once valves have been designed for a specific switching frequency, these valves can be used with the method according to the invention for the relevant length.

Further designs of the invention form the subject of the subclaims.

According to one preferred design of the invention the proportional capacity of the compressor corresponding to the current refrigeration requirement of a refrigeration location can be determined in line with the cycle of the time interval. The ratio of the proportional capacity of the compressor corresponding to the refrigeration requirement can further be compared with the percentage open time for each cycle of the valves determined in the past. It has also been found to be of advantage if at least two, and a maximum of 7, preferably 3 to 5, past time intervals are used for determining the percentage open time of the valves. A lower number will result in an excessive frequency of switching intervals, whilst an inclusion of more than 7 time intervals will result in a correspondingly slower adjustment to suit changed conditions of the refrigeration location.

It can further be envisaged that the period of the time interval is adjustable. A refrigeration location where the temperature must be maintained within a very narrow range must therefore be equipped with a faster reaction, and thus shorter time intervals, than a refrigeration location where less critical requirements apply.

The open time percentage of the valves over a number of time intervals can for example be determined with the formula listed below:

$$F = \frac{\Sigma_{I_{n-m}}^{I_n} V_t}{m+1}$$

with

F: open time percentage of the valves, $I_n$: current time interval, m: number of past time intervals to be taken into consideration, and $V_t$: status of the valves during a specific time interval t (100=open or 0=closed)

Further designs of the invention will be described in more detail below with reference to the description of an embodiment example and the drawing.

BRIEF DESCRIPTION OF THE DRAWINGS

The drawing shows

DETAILED DESCRIPTION OF ILLUSTRATIVE EMBODIMENTS

Figure 1:
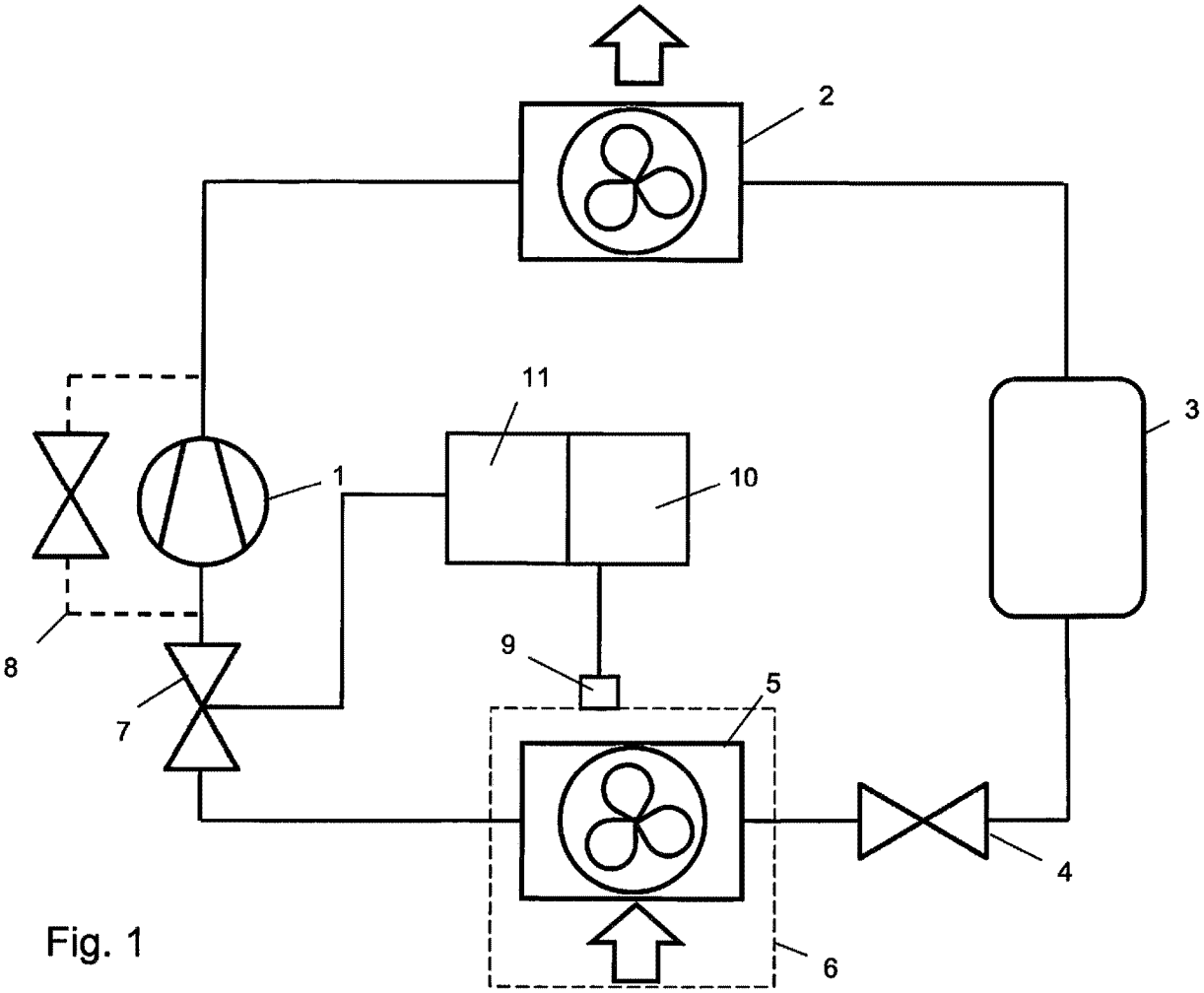
FIG. 1 a schematic diagram of a refrigeration system.

The refrigeration system schematically illustrated in FIG. 1 substantially consists of a compressor 1, a liquefier 2, a collector 3, an expansion valve 4 and an evaporator 5. Vaporous refrigerant is aspirated and compressed in the compressor 1, which is for example designed as a reciprocating compressor. In the downstream liquefier 2 the refrigerant is condensed and reaches the expansion valve 4 via the collector 3, where it is decompressed. During expansion the refrigerant pressure will fall, so that the refrigerant will cool and partially evaporate. In the evaporator 5, located in the area of a refrigeration location 6, the refrigerant will absorb the heat of the refrigeration location through evaporation. The compressor 1 then aspirates the evaporated refrigerant once more, so that the refrigerant circuit is closed. The refrigerant flow is controlled with the aid of at least one valve 7 located on or in the compressor depending on the refrigeration requirements of the refrigeration location 6. The valve 7 of the illustrated embodiment example is located on the aspiration side of the compressor 1, i.e. between the evaporator 5 and the compressor 1. An opening of the valve 7 will result in an increase in refrigerant flow, whilst a closing will lead to a reduction in the refrigerant flow.

Alternatively the valve 7 could also be located in a by-pass line 8 to the compressor 1 (variant illustrated by means of the broken line). With a valve located in a by-pass 8 the refrigerant flow through the compressor 1 would be increased when the valves are closed, and reduced when the same are opened.

A sensor unit 9, with which the percentage capacity S of the compressor 1 is determined for the corresponding current refrigeration requirement of the refrigeration location 6, is envisaged in the area of the refrigeration location 6. An evaluation unit 10 connected with the sensor unit 9 is also envisaged, and would determine the open time percentage F of the valves 7 over a number of time intervals I, whereby the time intervals include the current time interval $I_n$ and further preceding time intervals. A control device 11 connected with the evaluation unit is also envisaged and is designed in such a way that the valve 7 is opened for the following time interval $I_{n+1}$ if the ratio of the percentage capacity S of the compressor 1 corresponding to the refrigeration requirement is greater than that of the open time percentage F of the valves determined in the past, and the valve is closed for the following time interval $I_{n+1}$ if the ratio of the percentage capacity S of the compressor corresponding to the refrigeration requirement is smaller than that of the open time percentage F of the valves determined in the past.

The control of the valves 7 will now be explained in more detail with reference to a specific example and to FIG. 2. The vertical shaded bars illustrate the open position (V=100) of the valves 7 here. The white areas located between the same represent the closed position (V=0) of the valves 7. The length of a time interval I is 10 s with this embodiment example, and five time intervals, i.e. the current time interval $I_n$ and the preceding four time intervals ($I_{n-1}$, $I_{n-2}$, $I_{n-3}$, $I_{n-4}$) are formed for detecting the percentage open time F of the valves 7.

The open time percentage F of the valves 7 is indicated by means of the continuous line, and the percentage capacity S of the compressor corresponding to the current refrigeration requirement by means of the broken line.

Figure 2:
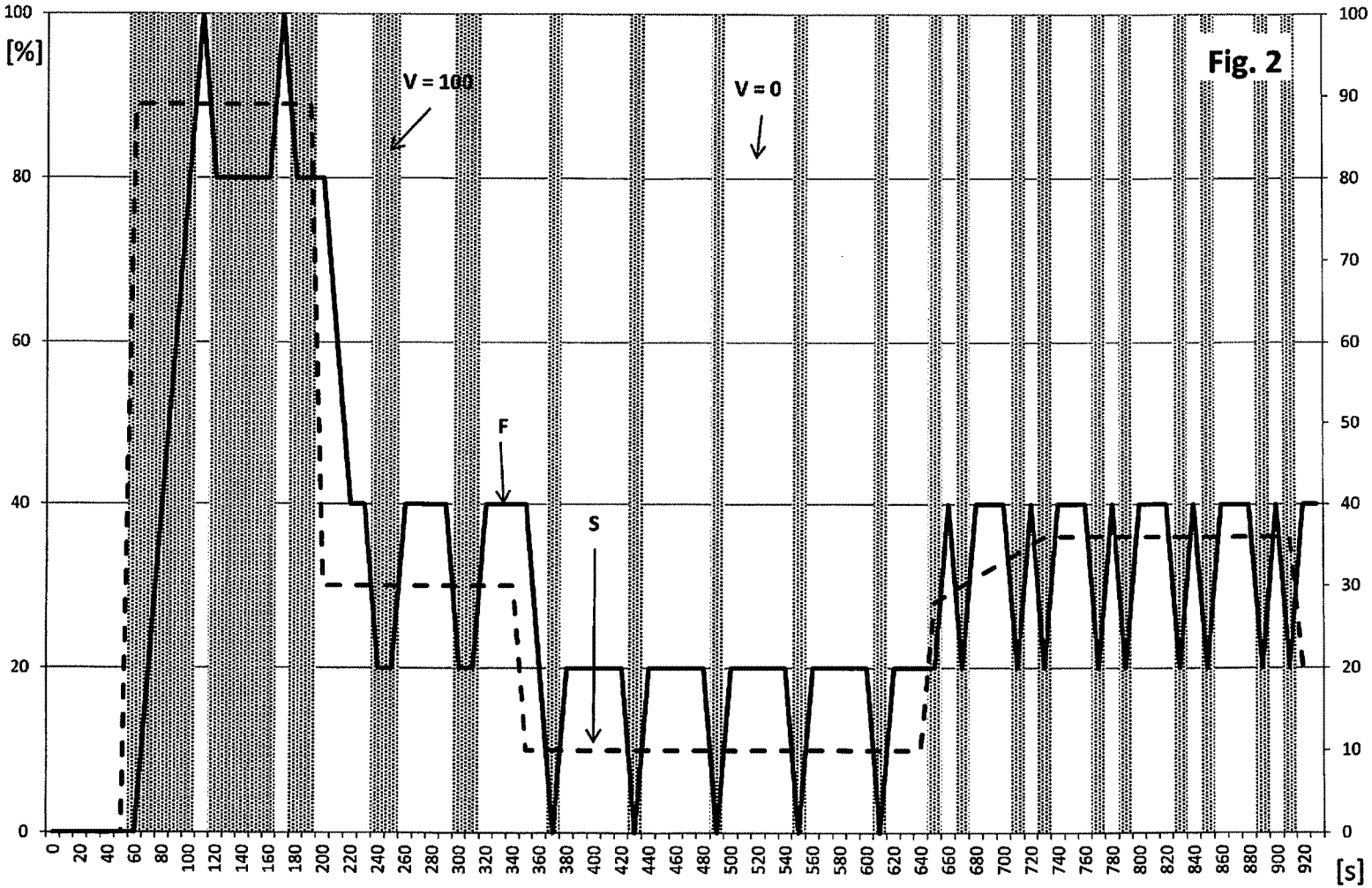
FIG. 2 an illustration of the valve position depending on the refrigeration requirements of the refrigeration location.

In the embodiment example illustrated in FIG. 2 the proportional capacity S of the compressor corresponds to the refrigeration requirement in the first five time intervals $I_1$ to $I_5$=0%. In time intervals $I_6$ to $I_{20}$ the capacity S=89% and then falls, first to 30% and later to 10%, before it increases once more.

The evaluation unit 10 determines the open time percentage F of the valves 7 over five time intervals with the formula listed below:

$$F = \frac{\Sigma_{I_{n-4}}^{I_n} V_t}{5}$$

with

F: open time percentage of the valves, $I_n$: current time interval, and $V_t$: status of the valves during a specific time interval $I_t$ (100=open or 0=closed)

If a refrigeration requirement for the refrigeration location did not exist in the first five time intervals, the percentage capacity S of the compressor as well as the open time percentage F of the valves=0, and the valve is closed. The following table shows the refrigeration requirement as a percentage capacity S of the compressor 1, the open time percentage F of the valves 7, and the valve condition V during the first 27 time intervals of the example illustrated in FIG. 2.

With the formula listed above, the valve condition of five time intervals is taken into consideration, which includes the current time interval and the four preceding time intervals. After every time interval the time window moves downward by one interval. Two such time windows are shown by way of examples in the following table.

| I | t [s] | S [%] | F [%] | V [%] | Algorithm | |
|---|---|---|---|---|---|---|
| 1 | 0 | 0 | 0 | 0 | S = 0; F = 0 | valve: closed |
| 2 | 10 | 0 | 0 | 0 | S = 0; F = 0 | valve: closed |
| 3 | 20 | 0 | 0 | 0 | S = 0; F = 0 | valve: closed |
| 4 | 30 | 0 | 0 | 0 | S = 0; F = 0 | valve: closed |
| 5 | 40 | 0 | 0 | 0 | S = 0; F = 0 | valve: closed |
| 6 | 50 | 89 | 0 | 100 | S = 89 F = 0 | valve: open |
| 7 | 60 | 89 | 20 | 100 | S = 89 F = 100/5 = 20 | valve: open |
| 8 | 70 | 89 | 40 | 100 | S = 89 F = 200/5 = 40 | valve: open |
| 9 | 80 | 89 | 60 | 100 | S = 89 F = 300/5 = 60 | valve: open |
| 10 | 90 | 89 | 80 | 100 | S = 89 F = 400/5 = 80 | valve: open |
| 11 | 100 | 89 | 100 | 0 | S = 89 F = 500/5 = 100 | valve: closed |
| 12 | 110 | 89 | 80 | 100 | S = 89 F = 400/5 = 80 | valve: open |
| 13 | 120 | 89 | 80 | 100 | S = 89 F = 400/5 = 80 | valve: open |
| 14 | 130 | 89 | 80 | 100 | S = 89 F = 400/5 = 80 | valve: open |
| 15 | 140 | 89 | 80 | 100 | S = 89 F = 400/5 = 80 | valve: open |
| 16 | 150 | 89 | 80 | 100 | S = 89 F = 400/5 = 80 | valve: open |
| 17 | 160 | 89 | 100 | 0 | S = 89 F = 500/5 = 100 | valve: closed |
| 18 | 170 | 89 | 80 | 100 | S = 89 F = 400/5 = 80 | valve: open |
| 19 | 180 | 89 | 80 | 100 | S = 89 F = 400/5 = 80 | valve: open |
| 20 | 190 | 89 | 80 | 100 | S = 89 F = 400/5 = 80 | valve: open |
| 21 | 200 | 30 | 80 | 0 | S = 30 F = 400/5 = 80 | valve: closed |
| 22 | 210 | 30 | 60 | 0 | S = 30 F = 300/5 = 60 | valve: closed |
| 23 | 220 | 30 | 60 | 0 | S = 30 F = 300/5 = 60 | valve: closed |
| 24 | 230 | 30 | 40 | 0 | S = 30 F = 200/5 = 40 | valve: closed |
| 25 | 240 | 30 | 20 | 100 | S = 30 F = 100/5 = 20 | valve: open |
| 26 | 250 | 30 | 20 | 100 | S = 30 F = 100/5 = 20 | valve: open |
| 27 | 260 | 30 | 40 | 0 | S = 30 F = 200/5 = 40 | valve: closed |

It can be seen from the above table that the refrigeration requirement S of the refrigeration location is 89% from interval 6. As the valve was previously closed it had to be opened for the $6^{th}$ time interval. The above formula is used for calculating the valve position for the $7^{th}$ time interval $I_7$. For this, the current time interval $I_6$ and the time intervals $I_2$ to $I_5$ are taken into consideration (see first time window in the table). As the valve was open during just one time interval out of these five time intervals, F results as:

$$F=1*100/5=20\%$$

As S—with 89%—is clearly greater than F, the valve remains open during the $7^{th}$ time interval. The valve is closed only for the $11^{th}$ time interval, as the valve has then been open for five time intervals (namely from the $6^{th}$ to the $10^{th}$ time interval) and the open time percentage F of the valves over the five time intervals is thus 100%, and S is therefore smaller than F.

From the $21^{st}$ time interval the refrigeration requirement S is only 30%. The valve is therefore closed again from the $21^{st}$ time interval. Accordingly, the value F for the open time percentage of the valves falls again steadily over the following time intervals. Time intervals 20 to 24 are evaluated (see second time window in the table) for detecting the valve position V for the $25^{th}$ time interval, whereby the valve was open only during one time interval, namely the $20^{th}$ time interval, during these time intervals. Accordingly, an open time percentage of just 20% results, which is below the refrigeration requirement S of 30%. The valve is therefore opened again during the $25^{th}$ time interval.

The further progress of the refrigeration requirements and the relevant values for the open time percentage F of the valves and the valve condition V can be seen in FIG. 2. It is clear here that the valve condition V does not need to be changed during every time interval, as would be the case with a pulse width modulated signal. It can be seen from the above table that the valve condition was changed only 8 times during the first 27 time intervals. Despite this it was possible to react immediately to a change in refrigeration requirements S at the beginning of every new time interval, i.e. after no more than 10 s. The refrigerant flow through the compressor can therefore react in a timely way to changes in the refrigeration requirements of the refrigeration location. A new refrigeration requirement of the refrigeration location is implemented even faster with the method according to the invention, as the valve is maintained open or closed until the refrigeration requirement is fulfilled. With a pulse width modulated signal the new refrigeration requirement is fulfilled more slowly, as the valve is controlled with the exact opening and closing times, the ratio of which complies with the new refrigeration requirement. However, the greatest advantage of the above methods lies in the clearly reduced switching frequency of the valves. Depending on the progress of refrigeration requirements of the refrigeration location 6 the switching frequency of the valves can be reduced up to 75% and more. This in turn guarantees a correspondingly longer working life of the valves.

The invention claimed is:

1. A method for controlling a compressor of a refrigeration system comprising a motor, whereby a controller controls the refrigerant flow through the compressor via at least one valve, whereby the valve is controlled in a cycle of consecutive time intervals (I) of an identical length, either in the sense of opening or in the sense of closing, so that the valve is either completely closed or completely open during a time interval (I), the method including the steps of a. determining a percentage capacity (S) of the compressor corresponding to the current refrigeration requirement of a refrigeration location, b. determining an open time percentage (F) of the valve over a number of time intervals (I) including a current time interval ($I_n$) and further preceding time intervals, c. opening the valve for a following time interval ($I_{n+1}$) when the ratio of the percentage capacity (S) of the compressor corresponding to the refrigeration requirement is greater than that determined for the open time percentage (F) of the valve in the past, and d. closing the valve for the following time interval ($I_{n+1}$) when the ratio of the percentage capacity (S) of the compressor corresponding to the refrigeration requirement is smaller than that determined for the open time percentage (F) of the valve in the past.

2. The method according to claim 1, characterised in that the time interval (I) used lies within a range of 2 s and 20 s.

3. The method according to claim 1, characterised in that the percentage capacity (S) of the compressor corresponding to the current refrigeration requirement of a refrigeration location is determined during the cycle of the controller of the valve.

4. The method according to claim 1, characterised in that the ratio of the percentage capacity (S) of the compressor corresponding to the refrigeration requirement is compared with the percentage open time (F) for each cycle of the valve determined in the past.

5. The method according to claim 1, characterised in that at least 2, and a maximum of 7, past time intervals (I) are used for detecting the percentage open time (F) of the valve.

6. The method according to claim 1, characterised in that the period of the time interval (I) can be adjusted.

7. The method according to claim 1, characterised in that the open time percentage (F) of the valve is determined over a number of time intervals with the aid of the formula listed below:

$$F = \frac{\Sigma_{I_{n-m}}^{I_n} V_t}{m+1}$$

with

F: open time percentage of the valve, $I_n$: current time interval, m: number of past time intervals to be taken into consideration, and $V_t$: status of the valve during a specific time interval $I_t$ (100=open or 0=closed).

8. A compressor of a refrigeration system, with a motor compressing a refrigerant flow, at least one valve influencing the volume of the refrigerant flow through the compressor, a control device controlling the valve, whereby the valve can be controlled in a cycle of consecutive time intervals (I) of an identical length, either in the sense of opening or in the sense of closing, so that the valve is either completely closed or completely open during a time interval (I), at least one sensor unit detecting a percentage capacity (S) of the compressor corresponding to the current refrigeration requirement of a refrigeration location, an evaluation unit detecting a percentage open time (F) of the valve over a number of time intervals (I) including a current time interval (I) and further preceding time intervals, whereby the control device is connected with the evaluation unit and is designed in such a way that the valve is opened for a following time interval ($I_{n+1}$) when the ratio of the percentage capacity (S) of the compressor (1) corresponding to the refrigeration requirement is greater than the open time percentage (F) of the valve determined in the past, and the valve is closed for the following time interval ($I_{n+1}$) when the ratio of the percentage capacity (S) of the compressor corresponding to the refrigeration requirement is smaller than the open time percentage (F) of the valve determined in the past.

* * * * *